US009920543B2

(12) United States Patent
Budenbender et al.

(10) Patent No.: US 9,920,543 B2
(45) Date of Patent: Mar. 20, 2018

(54) ROOF SAFETY RAIL SYSTEM

(76) Inventors: Michael B. Budenbender, Shawnee, KS (US); Matthew S. Small, Spring Hill, KS (US)

( * ) Notice: Subject to any disclaimer, the term of this patent is extended or adjusted under 35 U.S.C. 154(b) by 0 days.

(21) Appl. No.: 13/250,195

(22) Filed: Sep. 30, 2011

(65) Prior Publication Data

US 2013/0082227 A1 Apr. 4, 2013

(51) Int. Cl.
*E04G 21/32* (2006.01)

(52) U.S. Cl.
CPC ..... *E04G 21/3223* (2013.01); *E04G 21/32* (2013.01); *E04G 21/3214* (2013.01); *E04G 21/3242* (2013.01); *Y10T 29/49947* (2015.01)

(58) Field of Classification Search
CPC . E04G 21/32; E04G 21/3214; E04G 21/3219; E04G 21/3223; E04G 21/3233; Y10S 256/06
USPC ..... 182/112, 113; 428/143
See application file for complete search history.

(56) References Cited

U.S. PATENT DOCUMENTS 3,867,997 A * 2/1975 Hyslop, Jr. ..... 182/113
3,995,833 A * 12/1976 McLaughlin et al. ..... 256/59
4,589,804 A * 5/1986 Paeglis et al. ..... 405/270
5,154,256 A * 10/1992 Wood ..... 182/113
5,263,550 A * 11/1993 Jines et al. ..... 182/113
6,038,829 A * 3/2000 Franks ..... 52/645
6,039,150 A * 3/2000 Palmer ..... 182/113
6,053,281 A * 4/2000 Murray ..... 182/113
6,270,057 B1 * 8/2001 Highley et al. ..... 256/32
6,276,668 B1 * 8/2001 Sweeley ..... 256/59
6,526,701 B2 * 3/2003 Stearns et al. ..... 52/24
6,547,223 B1 * 4/2003 Letourneau ..... 256/65.02
6,679,482 B2 * 1/2004 Allenbaugh ..... 256/65.14
6,908,075 B1 * 6/2005 Nichols ..... 256/59
7,806,232 B2 * 10/2010 Thomas et al. ..... 182/45
8,424,851 B2 * 4/2013 Christoffer et al. ..... 256/65.14
2003/0015696 A1 * 1/2003 Watson ..... 256/65.14
2005/0167198 A1 * 8/2005 Pelletier ..... 182/138
2006/0054393 A1 * 3/2006 Eisenkrein ..... 182/113
2008/0041662 A1 * 2/2008 Despres ..... 182/113

* cited by examiner

*Primary Examiner* — Colleen M Chavchavadze
(74) *Attorney, Agent, or Firm* — Polsinelli, PC

(57) ABSTRACT

The present relates generally to a roof safety rail for use on a building for fall prevention. In particular the inventions relates to a roof safety rail system for use on the outer perimeter of a roof that provides an improved safety rail system where permanent installation is accomplished without penetrating the roof membrane or the exterior roofing material that covers the anchoring points of safety rail whereby eliminating the possibility of weather elements entering the building through the rail fasteners.

9 Claims, 6 Drawing Sheets

ROOF SAFETY RAIL SYSTEM

FIELD OF INVENTION

The present invention relates generally to a roof safety rail for use on a building for fall prevention. In particular the inventions relates to a roof safety rail system for use on the outer perimeter of a roof that provides an improved roof safety rail system where permanent installation is accomplished without penetrating the exterior roof membrane or the exterior roofing material that covers the anchoring points of the safety rail whereby eliminating the possibility of weather elements entering the building through the fasteners used to secure the roof safety rail system.

BACKGROUND

Federal and state regulations, as well as insurance providers, require the use of roof safety systems to prevent workers from falling from a roof during construction or maintenance repairs. In certain instances if the proper safety procedures are not followed, governmental organizations such as OSHA can levy fines against companies and building owners due to non-compliance.

The safety systems are important from a regulation standpoint and a good business practice. The systems design protects workers from accidental falls and the resulting injuries or death that can occur. Minimizing these types of accidents and the resultant repercussions is important to a company. Currently, there are numerous safety rail systems used in the industry with the systems divided into two categories, a) permanent and b) temporary. Both types of systems ensure the safety of workers and have important distinct features but both have limitations.

Temporary rail safety system designs used in the industry allow a worker to erect the temporary system on the roof of a building, which allows a worker to complete a task and then remove for later use. The erection of a temporary system does not require penetrating the roofing material, which can lead to exposure of the building to weather elements, such as water. But, because of the temporary nature of this type of rail safety system many limitations are readily apparent. First, temporary systems must be put in place before a worker can begin any maintenance work on the roof. Because the safety system is not permanently affixed to the structure it creates additional work before performing the maintenance, which can lead to the potential for non-compliance because the worker does not take the time to erect the temporary safety system or does not erect it correctly. In a worker's rush to accomplish a routine maintenance task on the roof, they may choose to not put in place the safety system. If work is undertaken without the safety system in place the building owner or company could be liable to OSHA or other governmental fines, even if an accident did not occur. Additionally, temporary rail safety systems can also lack in rigidity and may not provide the support or strength that a permanent rail safety system provides. This lack of stability and strength can lead to the failure of the temporary system and injury to a worker who relies on the rail safety system.

Permanent rail safety system designs are a permanent fixture installed on the roof of a building to ensure compliance and safety standards are met. Permanent systems provide a strong and secure system because it is anchored to the building. The numerous permanent rail safety systems available on the market require anchoring to the roof through the penetration of the roof membrane, such as the use of pitch pockets, resulting in the possibility of weather elements, such as rain and snow entering and causing damage to the building. The permanent system designs fixedly attach to the building through known anchoring mechanisms, but the attachment requires penetration through the roof and into the building. To minimize the potential for water leakage because of the roof penetration, application of materials such as caulking, tar, or other water repellant products to where the roof penetration occurs helps, but ultimately the products are known to fail and leave the roof vulnerable to exposure to weather elements. Because of the requirement for creating a break in the exterior roofing membrane, an owner must maintain the penetrations continually to ensure the products used to create a water tight roof system do not fail.

Therefore a need exists for a roof safety system designed for permanent affixation to the building structure ensuring a strong secure attachment, but does not require penetration through the roof membrane, further ensuring the roof is water tight. The roof safety system design should include permanent affixation but allow the reuse of roofing materials such as drip edges, gravel stops, rakes copings and gutters for retrofit construction or standard roofing materials as described above for new construction to create the water tight exterior. The roof safety system will allow the roof membrane to cover all fasteners used to affix or secure the rail safety system to the roof creating a safety system that will not require continual maintenance and supervision to ensure a functional weather tight roof exterior.

SUMMARY OF THE INVENTION

The present invention is a safety roof rail system configured for permanent attachment to a building. The roof safety system includes an anchor plate, a sleeve, a stanchion, and a rail configured for permanent attachment to a building without penetrating the building's exterior roofing system to create the roof safety system The roof safety system design provides a permanent railing system for installation on the perimeter of a building's roof to ensure that when a worker conducts maintenance or is on the roof that all government regulations and insurance requirements are met for use of proper safety railings.

A further object of the invention is to provide a permanent safety rail system that when installed does not penetrate the roof membrane or outer surface of the roof. Limiting the penetration of the roof membrane or outer surface of the roof, minimizes the risk of weather elements, such as water, entering the building especially through the fastener attachments and causing damage to the structure.

A further object of the invention is to provide a safety rail system for use with existing roofing systems. The safety rail system configuration for use on an existing roof allows the reuse of roof materials such as copings, drip edges, gutters, rakes, and gravel stops after installing the safety rail system. Additionally, the safety rail system installation on new construction allow the use of standard roof materials to create a complete covering that covers and conceals all fasteners used to secure the safety rail system to the building. Since covering the fasteners occur, without penetrating the outer membrane, a better weather tight roof system is present requiring less maintenance and continual supervision.

To meet the objects the safety rail system invention generally comprises a plurality of anchor plates configured in an L-shape, a plurality of sleeve members configured to attach to the anchor plates and further receive a stanchion, the system includes a plurality of stanchions for use with the plurality of sleeves allowing insertion of the stanchions into the sleeves in an upright orientation, and at least one safety rail configured to attach to the stanchions creating a boundary around the perimeter of the building. The anchor plate and sleeve configuration allow the anchoring of the safety system to the building through the use of typical fasteners, but the configuration of the anchor plate allows for the contour to follow that of the building whereby allowing standard roofing components to cover the fasteners creating a weather tight roof system.

Other objects of the present invention relate to a permanent roof railing system that does not penetrate the outer surface of the roof membrane will become readily apparent upon reading the following detailed description in conjunction with the accompanying drawings and claims.

BRIEF DESCRIPTION OF THE DRAWINGS

The accompanying drawings illustrate embodiments of the invention and are for illustration by way of example and not limitations.

DETAILED DESCRIPTION OF THE INVENTION

Figure 1:
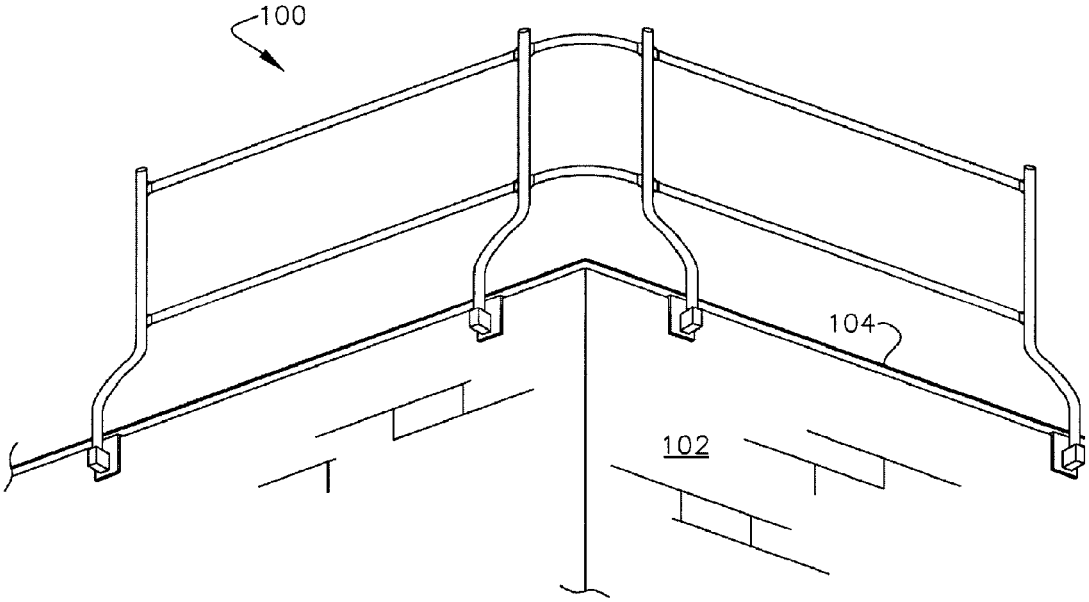
FIG. 1 illustrates a bottom perspective view of the safety rail system installed on the perimeter of the building.

The present invention is to a roof safety rail apparatus as shown in FIGS. 1-6 and a method for using. Specifically, the invention is to a permanent roof safety rail system configured for installation on the perimeter of a roof without penetrating the roof membrane.

The rail safety system is shown in multiple views in FIGS. 1-6 and the configuration provides a barrier on the perimeter of a roof to aid in the safety of workers. As shown in FIGS. 2-6 the rail safety system 100 includes an anchor plate member 10 configured for attachment to the building 102. In one embodiment, the anchor plate member 10 design is a general L-shape configuration that includes a generally vertical and generally horizontal surface for contacting and attachment to the building. In one embodiment, the anchor plate includes a first surface 20 and second surface 22 that are sections of the anchor plate member 10 perpendicular to each other such that the section of one surface is a vertical surface (first surface 20) and the opposing end of the anchor plate member 10 section is a second surface that is a horizontal surface (second surface 22) with a bend included in the intermediate between the vertical surface and horizontal surface. In one embodiment, the horizontal surface will include a lip to contact and communicate with the roof of the building. The lip will be from 1 inch to 12 inches. In one embodiment, the vertical surface will communicate and contact the building and will extend from 3 inches to 20 inches. In an alternative embodiment the vertical surface may not contact the building. The general L-shape design allows the horizontal surface to lay flush with the horizontal surface of the roof while the vertical surface of the anchor plate 10 aligns with the outside outer wall of the perimeter of the building. In another embodiment, the first and second surface are not perpendicular to each other but are designed to contour to the shape of the building such that the first surface will match the angle or slope of the roof and the second surface will match the angle of the outer wall. The design and contour of the anchor plate 10 creates direct contact between the anchor plate and the building ensuring good communication and proper attachment. In an alternative embodiment the anchor plate 10 contours to the building but may include an intermediate member, such as a gasket, film, rubber or similar products known in the art to aid in solidifying the anchor plate in place on the building. The anchor plate member is generally configured as a rectangular plate with an angle intermediate the ends to create the L-shaped design. In one embodiment, the intermediate is configured to contour to the angle where the roof of the building meets the outer wall. In another embodiment the plate member can be generally configured in any shape, such as a square, circle, oval, elliptical, or any known shape with the included angle 40 intermediate the ends to create an anchor plate that will contour to the configuration of the building. The anchor plate is made of any material used in the industry to fabricate safety rail systems, including but not limited to metal, such as steel and aluminum, wood, plastic, other man-made materials, as well as any material approved for use to ensure the safety structure meets OSHA standards. In one embodiment, the anchor plate is made of steel with a thickness of 1/16 to 5/16 of an inch. The thickness of the anchor plate can be greater than 5/16 of an inch and will depend on the desired end use and the roof materials that will be used to create a weather tight roof.

Figure 2:
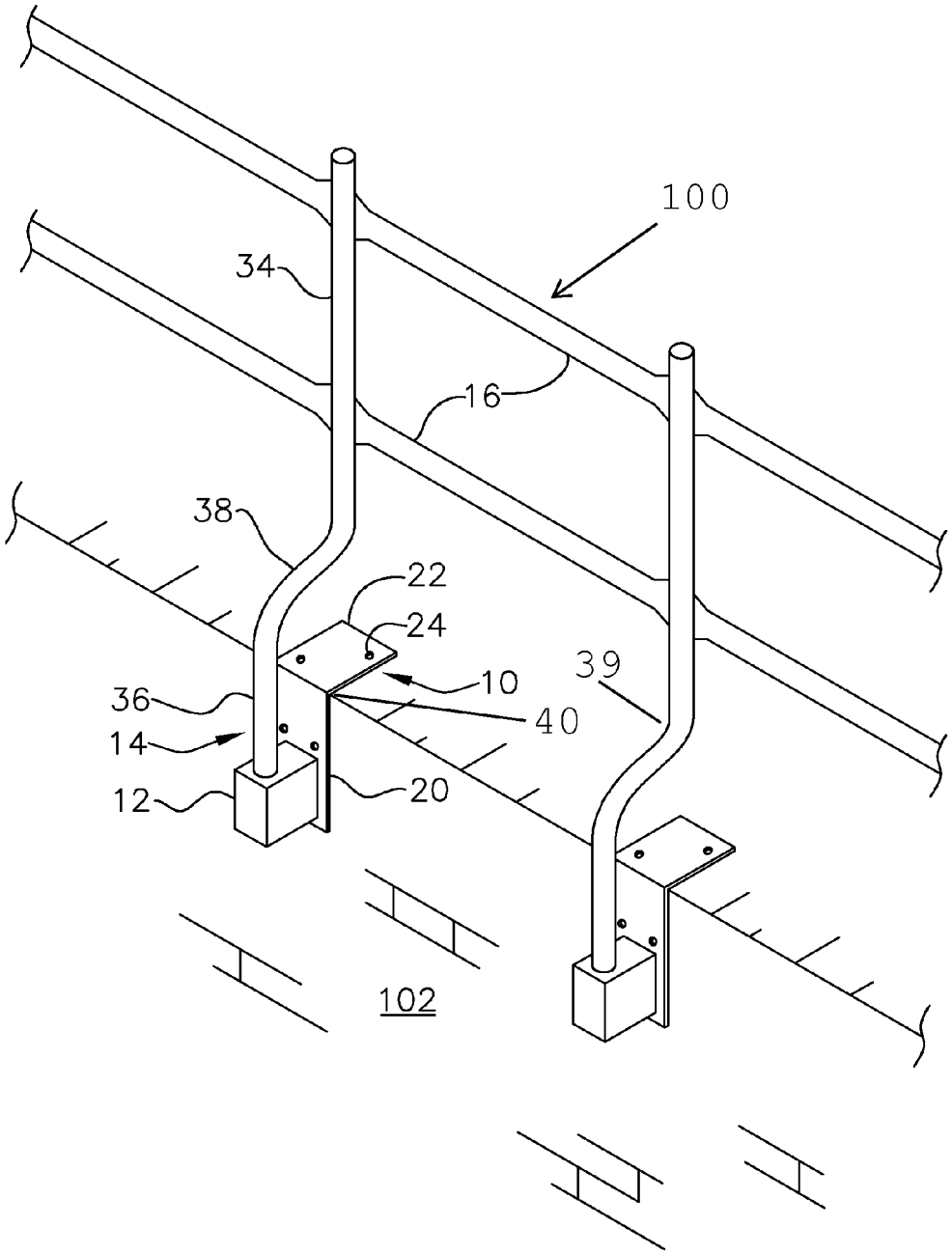
FIG. 2 illustrates a top perspective view of the safety rail system.
Figure 3:
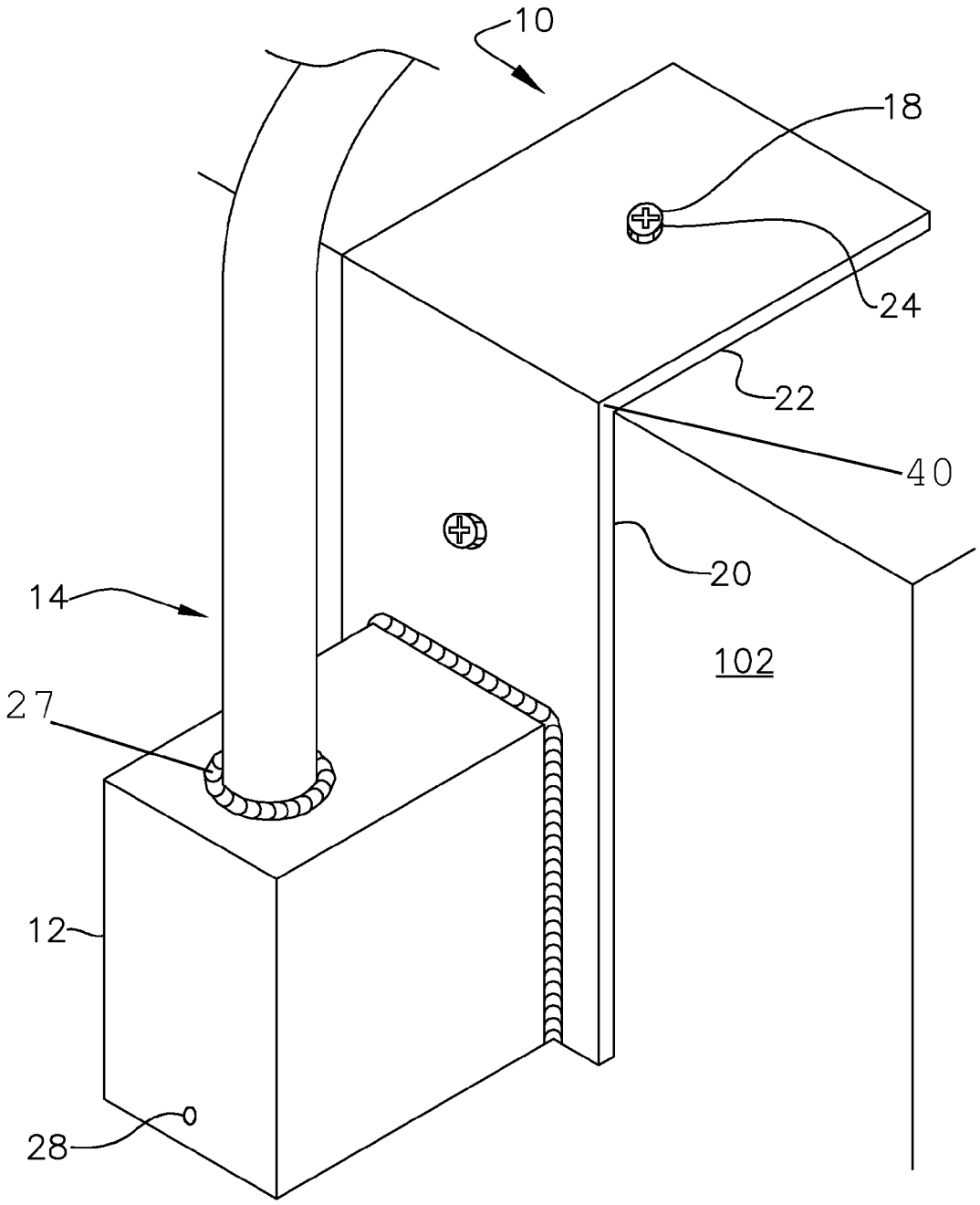
FIG. 3 illustrates a perspective view of the anchor plate.
Figure 4:
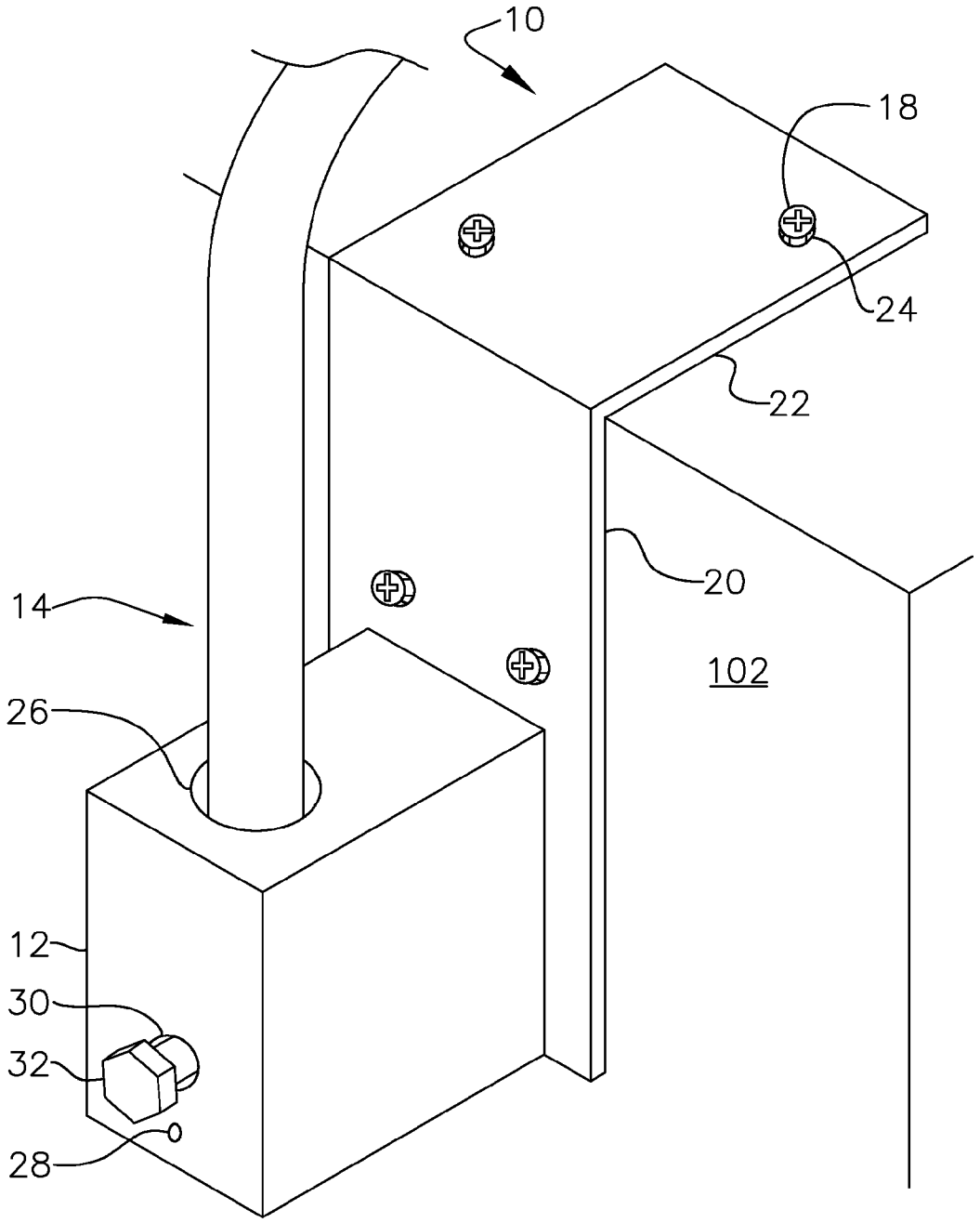
FIG. 4 illustrates a perspective view of the anchor plate.
Figure 5:
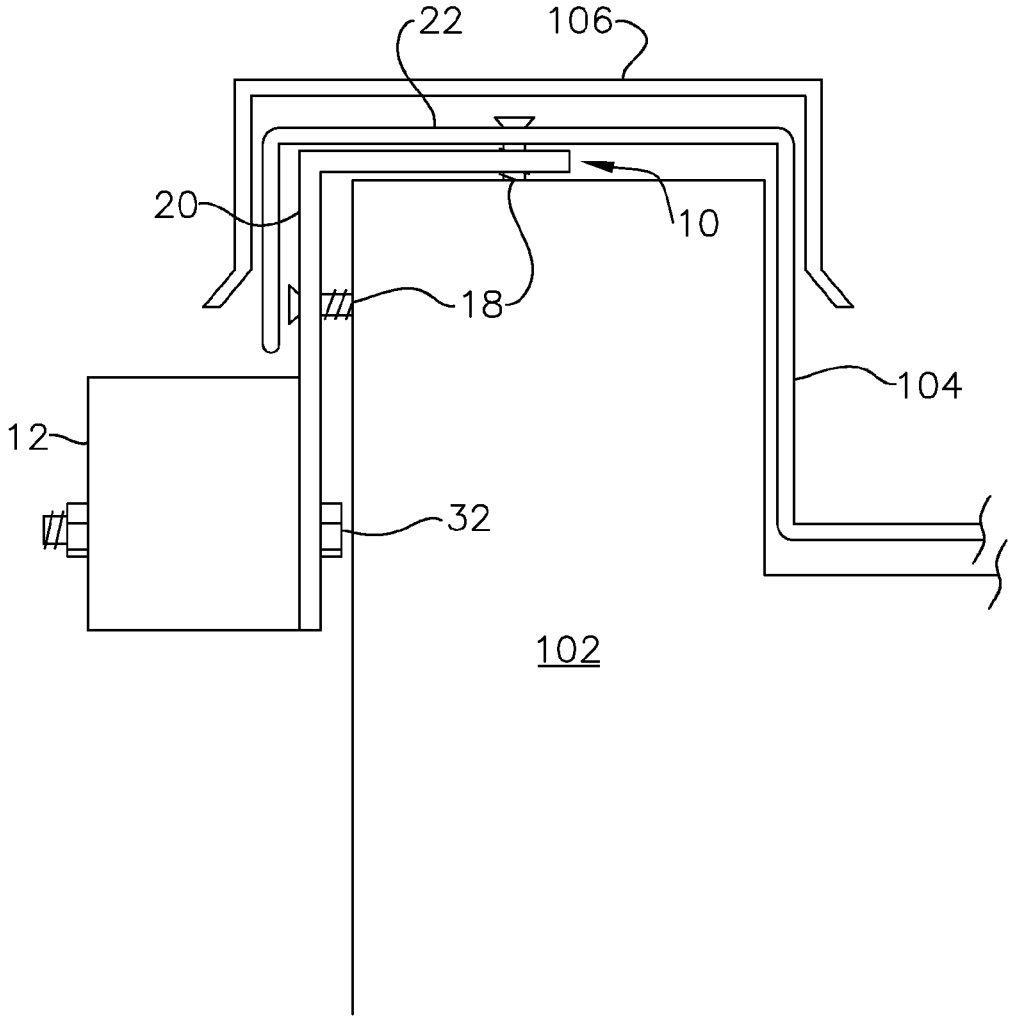
FIG. 5 illustrates a side view of the anchor plate for use on a roof cap, in use with the roofing material.
Figure 6:
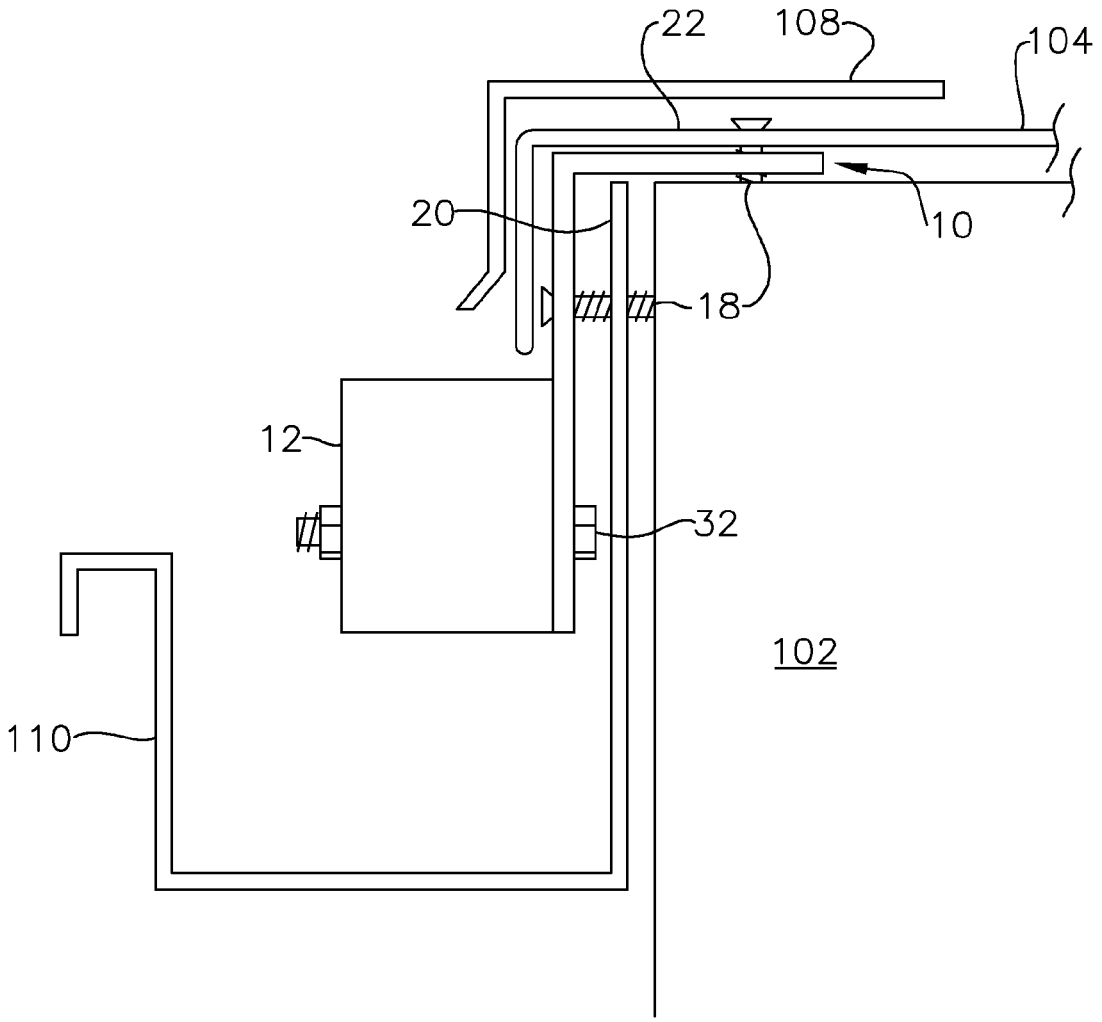
FIG. 6 illustrates a side view of the anchor plate used with a gutter system.

The anchor plate design allows the rail safety system to be attached to the building in a permanent manner as shown in FIGS. 2, 5 and 6. Attachment of the anchor plate is accomplished by the inclusion of through-holes 24 allowing fasteners 18 to pass through the anchor plate 10 into the building 102 to create a secure attachment of the anchor plate to the building. In one embodiment, the anchor plate 10 includes a through-hole 24 on the vertical surface 22 as demonstrated in FIG. 3. In another embodiment the anchor plate includes one or more through-holes 24 on the vertical surface 22 and one or more through-holes 24 on the horizontal surface 20 as demonstrated in FIG. 4. The placement and number of through holes can vary and will depend on the desired installation and building requirements for a specific project. In one embodiment, the through-holes are designed for placement such that when standard roofing materials such as the roof membrane 104, drip-cap 108, or copings (coping caps) 106 are used they will cover the fasteners as demonstrated in FIGS. 5 and 6. In another embodiment the through-hole placement is configured for placement ½ to 2 inches above the sleeve member 12. The placement of the through-holes on the horizontal surface ensures a strong and steady attachment to the outer wall of the building and minimize leverage and movement dependent on the overall height of the stanchion 14 and/or rail 16 height. The through-holes configuration allows any fastener, such as screws, lag bolts, nails, rivets, masonry anchors, or any other anchoring product used in the industry and designed for the desired building structure to attach the anchor plate to the building.

The safety rail system further includes a sleeve member 12 designed to attach to the anchor plate 10 and receive a stanchion 14. In one embodiment, the sleeve member is configured in a rectangular dimension with a flat surface to allow the sleeve to communicate with the vertical surface 22 of the anchor plate. In another embodiment, the sleeve member is a semicircular or any other dimension but includes a flat surface to communicate with and contour to the anchor plate surface. In one embodiment, the sleeve is attached to the end of the vertical surface opposite the horizontal surface. The design of the sleeve creates a surface that communicates with and contours to the anchor plate to ensure proper attachment. In another embodiment, the sleeve can be any dimensional shape as long as it contours to the surface of the anchor plate to allow attachment to the anchor plate. The longitudinal axis of the sleeve extends in a general vertical direction with the vertical surface of the anchor plate. The design of the sleeve includes a first opening 26 at one end, positioned such to receive a stanchion 14 and directing the stanchion in a generally vertical position extending away from the sleeve. In another embodiment, the sleeve will include a second opening to act as a weeping hole 28 to ensure if any moisture enters the sleeve or stanchion that it can escape. The weep hole general location is opposite the first opening, but can be located anywhere on the sleeve that will allow moisture to escape. In one embodiment, the sleeve is fixedly attached to the anchor plate by any means known in the industry such as welding 42 or other permanent attachment to the outer surface of the anchor plate as demonstrated in FIG. 3. In another embodiment, the anchor plate can be manufactured out of a single piece of material that includes the sleeve created on the vertical surface of the anchor plate. In another embodiment, the sleeve is removeably attached to the anchor plate by any means known in the industry, such as a screw, blot, nail, rivet, or an anchor system used in the industry. In this embodiment the sleeve can include an additional through-hole 30 to allow the attachment of the sleeve to the anchor plate. The sleeve 12 is made of any material used in the industry for safety systems, including but not limited to metal, such as steel and aluminum, wood, plastic, other man-made materials as well as any material approved for use to ensure the safety structure meets OSHA standards.

The sleeve 12 design receives a stanchion 14 in a slidably receiving action. The stanchion will fit within the sleeve and attach to the sleeve and/or anchor plate. In one embodiment, the sleeve will include a through-hole 30 to allow the attachment of the sleeve to the stanchion in a removable or fixed attachment. In one embodiment, the through-hole is positioned only through the sleeve member. In another embodiment, the through hole is positioned through the sleeve and the anchor plate. The through-hole design allows a fastening member 32, such as a screw, bolt, rivet, locking pin or any other anchor known in the industry to create an attachment between the sleeve and stanchion. In another embodiment the stanchion configuration allows for permanent attachment to the sleeve such as welding the sleeve and stanchion 27 together, or by any means known in the industry that permanently affix the stanchion and sleeve together.

The sleeve configuration holds the stanchion in a vertical orientation to create an upright for attachment of the rails 16 to create the safety rail system 100. The stanchion in one embodiment, is a tubular member configured to fit within the sleeve see FIG. 4. In an additional embodiment the stanchion can be of any dimensional material that allows for the stanchion to fit within the sleeve opening. The stanchion can be composed of any material known in the art used for safety railings, including but not limited to metal such as steel, aluminum, or other alloys, plastic, wood or any composite man-made material. In one embodiment, the stanchion is a nonlinear configuration. The nonlinear configured stanchion 14 includes three discrete portions, a top 34 and bottom 36 portion designed to be vertical when inserted into the sleeve and an intermediate portion 38 designed with an angle 39 in relationship to the top and bottom portion. In one embodiment, the bends or angles in the stanchion are configured to be greater than 90° to less than 180°. In another embodiment, the angles in the stanchion body can be any angle less than 360°. The specific configuration of the stanchion that includes a non-liner design allows the stanchion to extend vertically within the outer perimeter of the building roof to further increase the overall safety of the rail system, but the top portion remaining vertical and inset from the roof perimeter based on any governmental regulations or user requirements. The angle or angles of the bend in intermediate section of stanchion tailors to the specific building design to ensure added strength to the rail safety system and overall safety when in use. In another embodiment, the stanchion can be configured in a liner design without any angle or change in direction of the body of the stanchion. The stanchion can be composed of a single piece of material or more than one piece of material dependent on the specific roof configuration where it will be installed.

The rail safety system further includes safety rails 16 designed for attachment to the stanchions. In one embodiment, the stanchion will include a fastening mechanism to allow the attachment of safety rails. In another embodiment, the stanchion will include more than one fastening mechanism to attach more than one safety rail. The safety rails configuration is a perpendicular orientation with the stanchions and parallel to the roof surface. In one embodiment, the rail safety system will include two safety rails oriented parallel to each other and perpendicular to the stanchion. In another embodiment, the rail safety system will include two or more safety rails. In another embodiment, the rail safety system will include one safety rail. In one embodiment, the safety rail will attach to the vertical top portion of the stanchion. In another embodiment, the safety rail will attach to the angled intermediate portion of the stanchion. In another embodiment, the safety rail will attach to the bottom vertical portion of the stanchion. In another embodiment, the system will include more than one safety rail with attachment to a combination of the vertical top portion, the vertical bottom portion, the angled intermediate portion or combinations thereof. The safety rail composition includes any material known in the industry used to manufacture a safety rail including but not limited to metal such as steel or aluminum, metal wire/cable, plastic, wood or any other natural or man-made material. The safety rail can be a fixed dimension or alternatively adjustable in length to fit a desired space.

The rail safety system 100 design of the present invention allows easy installation and does not require penetration of the roof system. The anchor plate attaches to the building roof edge or perimeter lip edge of the roof and/or building outer wall. The anchor plate design allows for fasteners to pass into the building with a plurality of through-holes. The anchor plate L-design with through-holes on the horizontal surface of the anchor plate allows a user to securely affix the anchor plate to the roof horizontal surface or perimeter horizontal ledge of the roof. Additionally, through-holes on the vertical surface of the anchor plate allows the application of additional fasteners to the outer wall of the building for increased strength and stability. Any fastener known in the industry can be used but the specific fastener selected will depend on the building subsurface to which it attaches. The anchor plate contacts the surface of the building with the horizontal surface contacting the horizontal surface of the roof and the vertical surface of the anchor plate contacting the vertical surface of the building outer wall. The L-shape design of the anchor plate and attachment placement of the sleeve member allows for the anchor plate to rest under the roof system of the building. The anchor plate as designed will fit under drip edges, gravel stops, rakes, and copings. In addition the rail safety system design allows the anchor plate to fit within a gutter without modification or adjustments made to the gutter 110 system. Advantageously, the safety rail system can be used with existing roofing systems without the requirement of penetration of the roof material. By removing the requirement to penetrate the roof membrane the potential damage related to water leakage is minimized.

The design of the rail safety system allows the roof system, such as the drip edge, copings, rakes, or roof membranes to cover the anchor plate so no fastener used to attach the anchor plate is exposed to the elements. By covering the fasteners with the roof system of the building a rail safety system is permanently installed without the potential for weather elements such as rain and snow to contact the building subsurface where the fasteners attach. Installing a safety rail system that does not penetrate the roof system creates a superior safety system that requires less maintenance. Additionally, the design of the safety rail system allows a user to make repairs or complete replacement of the roofing materials without removing or altering the attachment of the safety rail system.

Thus, there has been described a roof safety rail system and a method for using. It is apparent to those skilled in the art, however, that many changes, variations, modifications, other uses, and applications to the support structure method for using are possible, and also such changes, variations, modifications, other uses, and applications which do not depart from the spirit and scope of the invention are deemed covered by the invention, which is limited only by the claims which follow.

What is claimed is:

1. A safety apparatus in combination with a roofing system that when installed creates a weather tight roof, the apparatus and the roof system consisting of:

a fixed L-shaped anchor plate member, wherein the fixed L-shaped plate member includes a vertical surface and a horizontal surface wherein the vertical surface consists of a hole on the vertical surface for receiving a fastener on the vertical surface and wherein the horizontal surface includes at least one hole on the horizontal surface for receiving a fastener on the horizontal surface, wherein the hole on the vertical surface and on the horizontal surface is configured for being covered by roofing material to create a weather tight roof;

a sleeve that communicates with the vertical surface; wherein the hole on the vertical surface is configured at least 0.5 inches above the sleeve to allow for being covered by a vertical portion of the roofing material, further wherein when the anchor plate member is fastened to the building, the horizontal surface and the hole of the vertical surface is capable of being covered by the roofing system;

a stanchion having a bottom portion received by the sleeve; and, at least one horizontal member configured for attachment to the stanchion, wherein the roof system is a roof membrane, drip edge, copings, drip caps, rakes or combination thereof.

2. The safety apparatus in combination with the roofing system of claim 1, wherein the fixed L-shaped anchor plate member comprises additional holes on the vertical surface, whereby creating a plurality of holes on the vertical surface for receiving a fastener, wherein the plurality of holes on the vertical surface are all configured at least 0.5 inches above the sleeve, and wherein when the fixed L-shaped anchor plate member is fastened to the building, the plurality of holes are capable of being covered by the roofing system to create a weather tight roof.

3. The safety apparatus in combination with the roofing system of claim 1, wherein the stanchion is attached to the sleeve, wherein attachment is selected from fixedly or removeably attachment.

4. The safety apparatus in combination with the roofing system of claim 1, wherein the sleeve further includes a weep hole.

5. The safety apparatus in combination with the roofing system of claim 1, wherein the sleeve is attached to the vertical surface of the plate member, wherein the attachment is selected from fixedly or removeably attachment.

6. The safety apparatus in combination with the roofing system of claim 1, wherein the stanchion is a tubular member configured with a top vertical portion, bottom vertical portion, and an intermediate angled portion.

7. The safety apparatus in combination with the roofing system of claim 1, wherein the at least one horizontal member is more than one horizontal member configured for parallel attachment to the stanchion.

8. The safety apparatus in combination with the roofing system of claim 1, wherein the at least one hole on the horizontal surface is a plurality of holes on the horizontal surface, whereby the plurality of holes on the horizontal surface are created for receiving a plurality of fasteners.

9. A roof safety rail system in combination with a roofing system consisting of: a fixed L-shaped anchor plate, wherein the plate member includes a vertical section with a vertical surface and a horizontal section with a horizontal surface, a plurality of holes located on the vertical surface and horizontal surface, a sleeve that includes one flat surface to communicate with the vertical surface of the fixed L-shaped anchor plate, wherein the plurality of holes on the vertical surface are configured 0.5 inches above the sleeve, wherein when the fixed L-shaped anchor plate member is fastened to the building, the horizontal surface and the plurality of holes on the vertical surface are capable of being covered by the roofing system to create a weather tight roof system; wherein the sleeve is fixedly attached to the fixed L-shaped anchor plate, a stanchion having a bottom portion configured for receipt by the sleeve, and a horizontal rail member configured for attachment to the stanchion.

* * * * *